US008770831B1

(12) United States Patent
Lalo

(10) Patent No.: US 8,770,831 B1
(45) Date of Patent: Jul. 8, 2014

(54) COUPLING PIN CONNECTION FOR SECURING A WATCHBAND TO A WATCHCASE

(75) Inventor: Eyal Lalo, Hallandale, FL (US)

(73) Assignee: Invicta Watch Company of America, Inc., Hollywood, FL (US)

( * ) Notice: Subject to any disclaimer, the term of this patent is extended or adjusted under 35 U.S.C. 154(b) by 47 days.

(21) Appl. No.: 13/553,262

(22) Filed: Jul. 19, 2012

(51) Int. Cl.
*A44C 5/14* (2006.01)

(52) U.S. Cl.
USPC ..... 368/282; 24/265 WS; 24/265 B; 224/177

(58) Field of Classification Search
USPC ..... 368/281, 282; 224/164, 177; 24/265 WS, 265 B
See application file for complete search history.

(56) References Cited

U.S. PATENT DOCUMENTS 2,536,007 A 12/1950 Milner
3,042,277 A * 7/1962 Stradella ..... 24/68 R
5,617,377 A 4/1997 Perret, Jr.
5,914,913 A 6/1999 Shriqui
5,951,193 A 9/1999 Yamamoto et al.
7,451,528 B2 11/2008 Sima
8,007,165 B1 8/2011 Lalo
2003/0035347 A1* 2/2003 Yokosuka ..... 368/281
2005/0207284 A1* 9/2005 Hiranuma et al. ..... 368/282
2007/0189126 A1* 8/2007 Hiranuma et al. ..... 368/282

* cited by examiner

*Primary Examiner* — Amy Cohen Johnson
*Assistant Examiner* — Matthew Powell
(74) *Attorney, Agent, or Firm* — Howard Natter; Natter & Natter

(57) ABSTRACT

A coupling pin connection for releasably attaching a watchband to a watchcase. The watchband includes an end connector that defines an aperture for interfitting engagement with a lug member projecting from the watchcase. The lug member defines a groove in communication with a recessed section formed in the watchcase. The end connector includes bore extending through shoulder portions on opposite sides of the aperture. A coupling pin member is selectively insertable through registered alignment of the bore and the groove. The coupling pin member further includes a spline. The spline is adapted for engagement within the recessed section when the coupling pin member is rotatable about its longitudinal axis to provide positive securement of the watchband to the watchcase.

12 Claims, 3 Drawing Sheets

FIG. 1
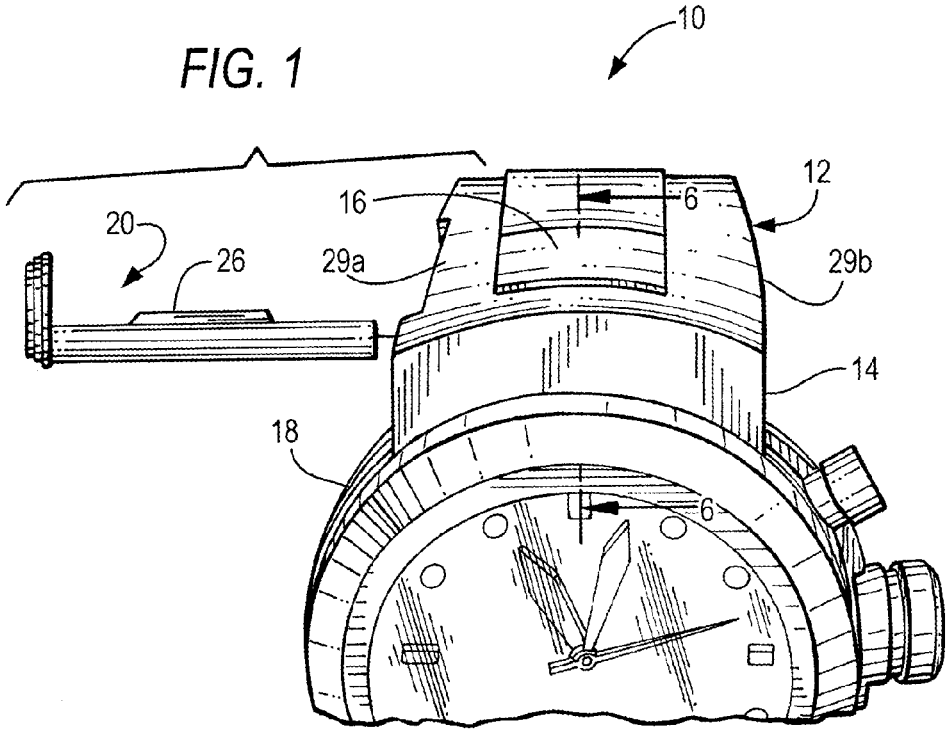
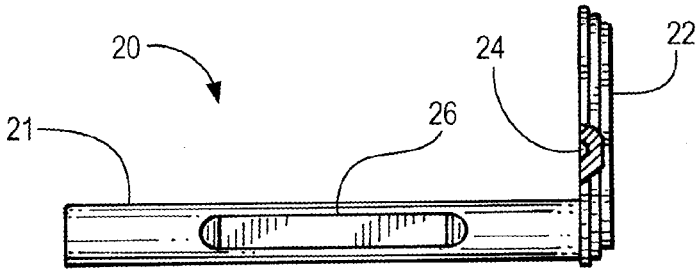
FIG. 2

COUPLING PIN CONNECTION FOR SECURING A WATCHBAND TO A WATCHCASE

BACKGROUND OF THE INVENTION

1. Field of the Invention

This invention relates to fastening devices and especially to pin connections.

In particular, this invention concerns a coupling pin connection for securing a watchband to a watchcase.

2. Description of Related Art

A watch typically includes a watchcase provided with a set of spaced apart projecting horns or lugs at a top and a bottom of the watchcase and a watchband that is attached to the lugs. Each set of lugs is bridged by a watchband cross-bar having a retractable spring-biased pin extending axially from the cross-bar. The respective ends of the pin are adapted to be received within a cavity formed in each of the lugs. The respective ends of the watchband are provided with a transverse bore to accommodate the cross-bar whereby the watchband can be linked to the lugs. The spacing of the cavity with respect to the watchcase is such that there is a clearance between the end of the watchband and the watchcase. In order to replace the watchband, the pins must be displaced inwardly with a suitable tool to release the cross-bar from the lugs after which the watchband can be decoupled from the watchcase.

Alternatively, the watchcase to watchband attachment may be provided by a threaded cross-bar.

A disadvantage of the previously described coupling arrangements is that, in many instances, the coupling procedure must be performed by a jeweler or skilled person having the necessary tools.

Another problem with the above-mentioned spring-biased coupling arrangements is that if a sufficient force is exerted upon the watchband, the cross-bar can snap or be deformed and the watchband can become detached from the watchcase.

A further shortcoming of the disclosed coupling arrangements is that they are not adapted for watch designs wherein the watchcase and the watchband are integral for aesthetic purposes and do not have a clearance between the watchcase and the watchband.

Yet another limitation of the above-noted coupling arrangements is that they do not provide for the quick release of the watchband for use with watches having interchangeable watchbands.

Several watchband coupling arrangements have attempted to overcome the above-noted deficiencies. For example, U.S. Pat. No. 5,951,193 discloses a mechanism for connecting a watchband without using a spring-pin. A stepped pin cooperates with a cocoon-shaped ring by pulling the watch casing and band longitudinally to connect the watchband. This arrangement however, does not provide the dependability and ease of use of the present invention.

The watchband coupling connection illustrated in U.S. Pat. No. 5,914,913 relies upon the interaction of a central bar having an opening and attachment lugs having cooperating pin shafts however, the pin shafts have tips that can be susceptible to failure. Furthermore, this connection does not encompass contiguous contact between the watchcase and the watchband.

U.S. Pat. No. 7,451,528 describes a watchband connection to a watchcase using a pin that is moveable into different positions relative to the band, however, this arrangement is not adaptable for facilitating removal of the pin or for compatible use with interchangeable watchbands.

The coupling assembly for a watchband as disclosed in U.S. Pat. No. 8,007,165 utilizes a threadably engageable screwbar. The coupling and decoupling requires a special tool for tightened and/or removal of the screwbar and therefore it is not as convenient to use as is the easily releasable coupling pin connection of this invention that does not require any special tools.

SUMMARY OF THE INVENTION

Briefly, this invention concerns a coupling pin connection for releasably securing a watchband to a watchcase. The watchband is provided with an end connector for attachment to a lug member projecting from the watchcase. The end connector includes an aperture conforming to the lug member for accommodatingly seating the lug member. The end connector further includes a first and a second lateral shoulder portion positioned respectively on opposite sides of the aperture. An aligned bore extends in the width dimension of the end connector, through both of the shoulder portions. The lug member has a groove being substantially circular in cross-section and extending across the width dimension of the lug member. The groove is registrable with the bore when the lug member is seated within the aperture. A portion of the groove contiguous to the watchcase undercuts the watchcase to form a recessed section. The recessed section is co-extensive with the groove. A coupling pin having a substantially cylindrical shaft and a longitudinal spline, is insertable through the bore in the first shoulder portion, for passage through the groove and into the bore of the second shoulder portion. The coupling pin is rotatable, about its longitudinal axis, to position the spline within the recessed section to prevent withdrawal of the coupling pin and to thereby secure the watchband to the watchcase.

Having thus summarized the invention, it will be seen that it is a preferred object thereof to provide an improved coupling pin connection for securing a watchband to a watchcase of the general character described herein which is not subject to the previous mentioned limitations and shortcomings.

A preferred object of this invention is to provide a coupling pin connection that is readily releasable and adapted for use with interchangeable watchbands.

An additional preferred object of this invention is to provide a coupling pin connection that does not require special tools or skill to operate.

A further preferred object of this invention is to provide a coupling pin connection that forms a gapless juncture between a watchband and a watchcase.

Yet still another preferred object of this invention is to provide a coupling pin connection that is reliable in use, durable in construction, and relatively easy to operate.

With these ends in view, the invention finds embodiment in certain combinations of elements and arrangements of parts by which the aforementioned preferred objects and certain other objects are hereinafter attained, all as more fully described with reference to the accompanying drawings and the scope of which is more particularly pointed out herein.

BRIEF DESCRIPTION OF THE DRAWINGS

In the accompanying drawings, in which is shown an exemplary embodiment of the invention:

FIG. 1 is a perspective view of a coupling pin connection in accordance with this invention showing a portion of a watch and a watchband having an end connector attached to a lug member and illustrating a coupling pin member removed from the end connector.

FIG. 2 is an enlarged perspective view of the coupling pin member showing a spline extending along the longitudinal axis of the coupling pin member and a tab extending substantially perpendicular to the axis of the coupling pin member;

DETAILED DESCRIPTION OF THE INVENTION

Figure 3:
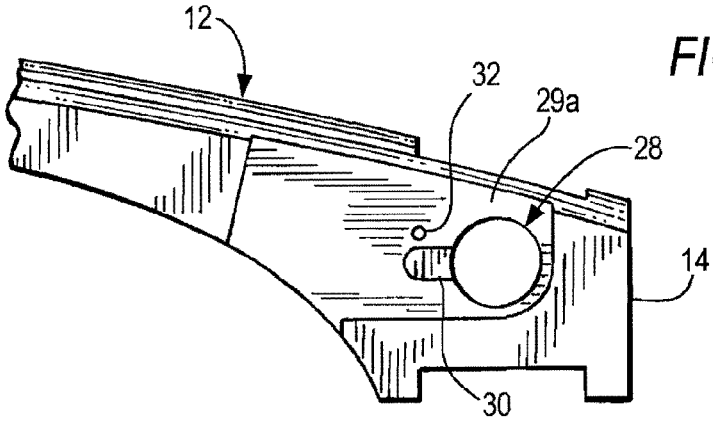
FIG. 3 is a left side elevational view with respect to FIG. 1 showing a bore and a keyway extending through a first shoulder portion in the end connector.

With specific reference now to the figures in detail, it is stressed that the particulars shown are by way of example and for the purposes of illustrative discussion of the preferred embodiment of the present invention only and are presented in a cause of providing what is believed to be the most useful and readily understood description of the principles and conceptual aspects of the invention. In this regard no attempt has been made to show aspects of the invention in more detail than is necessary for a fundamental understanding of the invention. The description when taken together with the drawings should make it apparent to those skilled in the art how the preferred form of the invention may be embodied in practice.

Referring now in detail to FIG. 1 of the drawings there is shown a coupling pin connection 10 of this invention for securing a watchband 12 to a watchcase 18. The watchband 12 includes an end connector 14 having an aperture 27, for interfitting engagement with a lug member 16 extending from the watchcase 18.

As referred to herein, the watchband 12 should be understood as encompassing a flexible strap comprised of leather, rubber, elastomers, such as polyurethane, or a combination of these or similar materials and/or a bracelet comprised of metal links or a combination of metal and nonmetal links or steel mesh or the equivalent.

The lug member 16 as shown herein extends from the top of the watchcase 18; a similar lug member (not shown) may also extend from the bottom and/or other locations on the watchcase 18. It should further become apparent that the coupling pin connection 10 may be used for releasably securing other items such as jewelry, to bands, such as bracelets, necklaces, and the like.

With reference now to FIG. 2, a coupling pin member 20, in this preferred embodiment, is comprised of a stem or shaft 21 being substantially cylindrical in shape. A tab 22, at one end of the shaft 21, extends substantially perpendicular thereto. The tab 22 is used to manipulate the coupling pin member 20 when in use. The tab 22 is further provided with a detent 24 for holding the coupling pin member 20 in a stabilized position as will be further discussed hereinafter. It should be additionally noted that a spline 26 projects along a portion of the longitudinal axis of the shaft 21.

Figure 4:
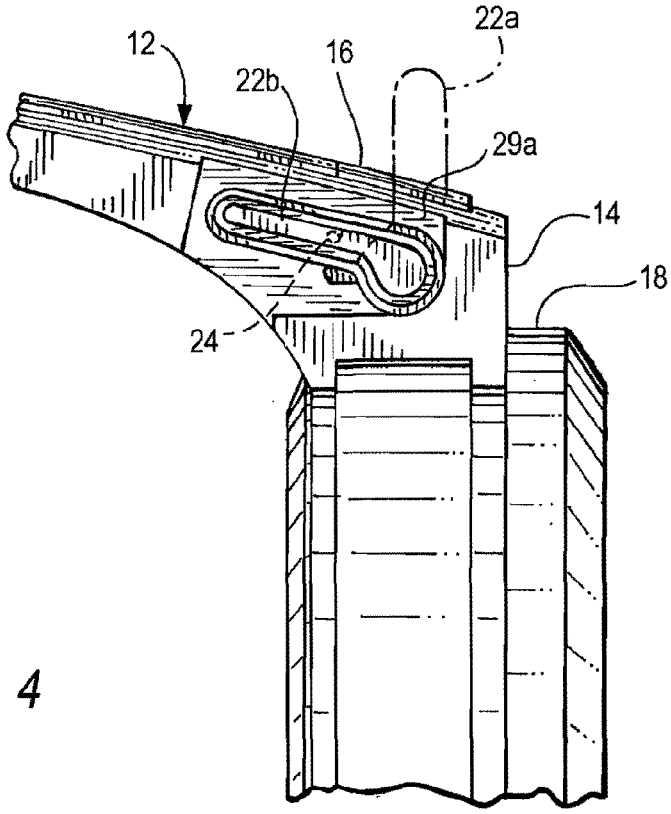
FIG. 4 is a left side elevational view corresponding to that shown in FIG. 3 illustrating the relative positioning of the coupling pin member during securement of the end connector to the watchcase.

In FIG. 3 there is shown a bore 28 and a keyway 30 formed in a first shoulder portion 29*a* of the end connector 14; the bore 28 also extends through a second shoulder portion 29*b*. The shaft 21 is adapted for accommodation within the bore 28 with the keyway 30 being sized to accept the spline 26. A nib 32 projecting from the first shoulder portion 29*a* is registrable with the detent 24 as shown in FIG. 4.

Figure 5:
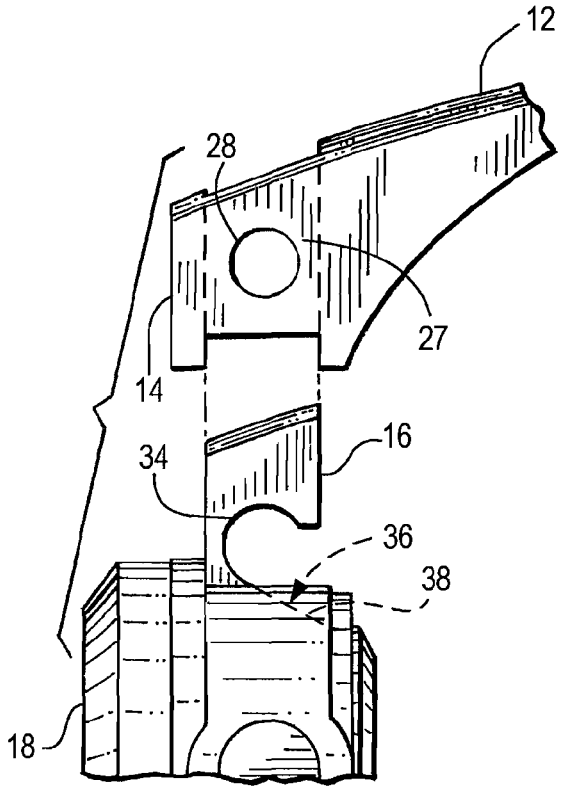
FIG. 5 is an exploded right side elevational view with respect in FIG. 1 showing a bore extending through a second shoulder portion of the end connector and a groove in the lug member defining a recessed section.

Referring once again to the lug member 16, and particularly with reference to FIG. 5, a groove 34, being substantially circular in cross-section, spans a width dimension of the lug member 16. A portion of the groove 34 that is contiguous to the watchcase 18 extends, in a radial direction, beyond the circular periphery of the groove 34 and undercuts the watchcase 18 to form a recessed section 36. In this preferred embodiment the recessed section 36 is co-extensive with the groove 34 and has a respective wall 38, 40 at opposite ends.

Figure 6:
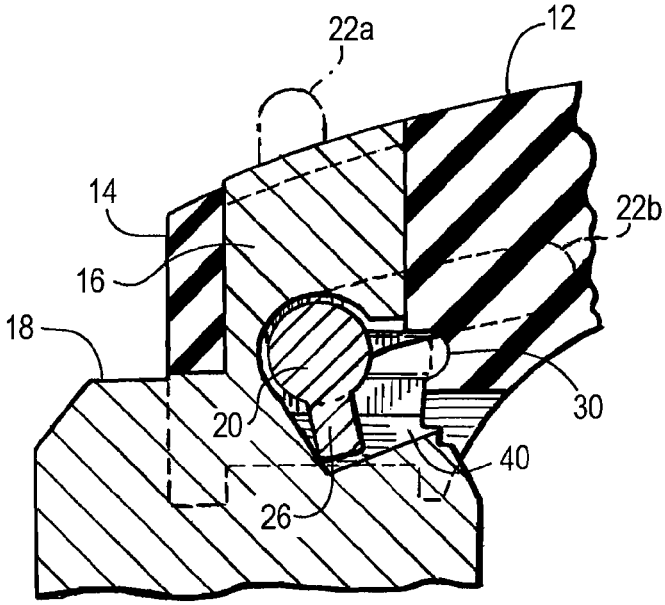
FIG. 6 is a sectional view taken substantially along lines 6-6 of FIG. 1 showing, in broken-line, the rotational displacement of the coupling pin member for engaging the spline within the recessed section.

In connection with the procedure for attaching the watchband 12 to the watchcase 18, the aperture 27 in the end connector 14 is placed over the lug member 16, as shown in FIG. 5 and the lug member 16 is then seated within the aperture 27 as shown in FIG. 6. In this position the bore 28, in the respective first and second shoulder portions 29*a* and 29*b* will be in registration with the groove 34. The coupling pin member 20 is then inserted into the bore 28 in the first shoulder portion 29*a*, with the spline 26 registered with the keyway 30. The coupling pin member 20 is then passed through the groove 34 and into the second shoulder portion 29*b*. After the coupling pin member 20 is fully inserted in the bore 28, it is rotated counter-clockwise, from an initial position at 22*a* to final position at 22*b* (see FIG. 6). The spline 26 will simultaneously be accommodated within the recessed section 36. In this preferred embodiment the length dimension of the spline 26 is substantially equivalent to the length dimension of the recessed section 36. The end walls 38, 40 of the recessed section 36 will prevent lateral movement of the spline 26 and will correspondingly secure the coupling pin member 20. It should also be noted that the detent 24 of the tab 22 co-acts with the nib 32 to stabilize the tab 22 and prevent unintentional movement of the coupling pin member 20.

When it is desired to remove the watchband 12, this can be quickly accomplished by disengaging the tab 22 from the nib 32 and rotating the coupling pin member 20, clockwise to remove the spline 26 from within the recessed section 36. The coupling pin member 20 can then be withdrawn and the watchband 12 can be replaced with a different watchband or an alternative watchcase can be substituted.

It should thus be apparent that there is provided a coupling pin connection for securing a watchband to a watchcase which achieves the various preferred objects of this invention and which is well adapted to meet conditions of practical use. Since other various possible embodiments might be made of the present invention or modifications might be made in the exemplary embodiment set forth above, it is to be understood that all materials shown and described with reference to the accompanying drawings are to be interpreted in an illustrative sense and not in a limiting sense.

Having thus described the invention, there is claimed as new and desired to be secured by Letters Patent:

1. A coupling pin connection for securing a watchband to a watchcase comprising a watchband having an end connector, said end connector defining an aperture, said aperture extending through the thickness dimension of the watchband, said end connector further including shoulder portions on opposed sides of the aperture, a bore extending transversely within the shoulder portions, said bore being in communication with the aperture, said watchcase having at least one lug member projecting therefrom, said lug member being snugly accommodatable within the aperture, a groove extending through the lug member, said groove defining a recessed section within the watchcase, a coupling pin member, said coupling pin member being selectively insertable into the bore in one of the shoulder portions for passage through the groove in the lug member and into the bore in the other of said shoulder portions, said coupling pin member further being rotatably displaceable about its longitudinal axis in a first direction for engagement with the recessed section to releasable secure the coupling pin member within the respective bores and to thereby secure the watchband to the watchcase.

2. A coupling pin connection for securing a watchband to a watchcase as claimed in claim 1 wherein said groove is registrable with the respective bores when the lug member is accommodated within the aperture.

3. A coupling pin connection for securing a watchband to a watchcase as claimed in claim 1 wherein the coupling pin member is rotatably displaceable about its longitudinal axis in a second direction for disengagement with the recessed section whereby the coupling pin member may be withdrawn from the respective bores and the watchband released from the watchcase.

4. A coupling pin connection for securing a watchband to a watchcase as claimed in claim 1 wherein the coupling pin member includes a spline, said spline projecting along a longitudinal axis of the coupling pin member, said spline being engageable within the recessed section when the coupling pin member is rotatably displaced in the first direction.

5. A coupling pin connection for securing a watchband to a watchcase as claimed in claim 4 wherein the bore, in at least one of the shoulder portions, defines a keyway for accommodating passage of the spline.

6. A coupling pin connection for securing a watchband to a watchcase as claimed in claim 4 wherein the length dimension of the spline is substantially equivalent to the length dimension of the recessed section.

7. A coupling pin connection for securing a watchband to a watchcase as claimed in claim 1 wherein the end connector is in contiguous contact with the watchcase to form a gapless juncture between the watchband and the watchcase when the coupling pin member is engaged with the recessed section.

8. A coupling pin connection for securing a watchband to a watchcase as claimed in claim 1 wherein the recessed section is co-extensive with the groove.

9. A coupling pin connection for securing a watchband to a watchcase comprising a watchband having an end connector, a watchcase having a lug member, said lug member being selectively engageable within the end connector, said lug member further defining a groove having a recessed section, a coupling pin member, said coupling pin member being insertable through the end connector and the groove in the lug member, said inserted coupling pin member further being rotatably displaceable along its longitudinal axis for engaging the recessed section to thereby secure the watchband to the watchcase.

10. A coupling pin connection for attaching a band to a case comprising a lug member extending from the case, said lug member defining a groove, a band end connector defining an aperture for receiving the lug member, said end connector including a bore, said bore being registrable with the groove when the lug member is seated within the aperture, said groove further being in communication with a recessed section in the case, a coupling pin member being insertable through the bore and the groove engaging with said coupling pin being selectively engagable with the recessed section to prevent withdrawal of the coupling pin member.

11. A coupling pin connection as claimed in claim 10 wherein the coupling pin member is substantially cylindrical and includes a spline along at least a portion of its longitudinal axis.

12. A coupling pin connection as claimed in claim 11 wherein the coupling pin member is rotationally displaceable about its longitudinal axis for positioning the spline within the recessed section.

* * * * *